US005558276A

United States Patent [19]

Barrett et al.

[11] Patent Number: 5,558,276

[45] Date of Patent: Sep. 24, 1996

[54] AIR GUN FOR SPRAYING AND DRYING AIR-DRYABLE LIQUID MATERIALS

[75] Inventors: Mark C. Barrett, New Hudson; Coy Barrett, Canton, both of Mich.

[73] Assignee: Tram-7 Precision, Inc., Redford, Mich.

[21] Appl. No.: 355,838

[22] Filed: Dec. 14, 1994

[51] Int. Cl.[6] ..... B05B 1/24; B05B 7/02

[52] U.S. Cl. ..... 239/135; 239/414; 239/528; 137/625.48; 137/872

[58] Field of Search ..... 239/135, 296, 239/297, 300, 413, 414, 415, 528, 527, DIG. 14; 118/302; 137/625, 48, 872, 874

[56] References Cited

U.S. PATENT DOCUMENTS

| | | | |
|---|---|---|---|
| Re. 33,481 | 12/1990 | Ziecker et al. | 239/298 |
| D. 281,391 | 11/1985 | Somers | D8/30 |
| D. 297,299 | 8/1988 | Krause | D8/30 |
| 2,564,896 | 8/1951 | Gustafsson et al. | 137/625.48 X |
| 4,065,057 | 12/1977 | Durmann | 239/79 |
| 4,200,234 | 4/1980 | Baldwin | 239/296 |
| 4,535,916 | 8/1985 | Macherle et al. | 222/113 |
| 4,637,745 | 1/1987 | Speisebecher et al. | 401/1 |
| 4,642,158 | 2/1987 | Steinel et al. | 156/497 |
| 4,785,996 | 11/1988 | Ziecker et al. | 239/298 |
| 4,795,064 | 1/1989 | Sheu | 222/113 |
| 4,948,053 | 8/1990 | Hufgard | 239/301 |
| 4,949,881 | 8/1990 | Watanabe et al. | 222/113 |
| 4,957,783 | 9/1990 | Gabryszewski | 427/424 |
| 4,970,985 | 11/1990 | Slautterback | 118/300 |
| 5,026,188 | 6/1991 | Capodieci | 401/1 |
| 5,048,722 | 9/1991 | Lichu | 222/80 |
| 5,065,943 | 11/1991 | Boger et al. | 239/298 |
| 5,088,648 | 2/1992 | Schmon | 239/296 |
| 5,154,322 | 10/1992 | Sim | 222/146.2 |
| 5,160,763 | 11/1992 | Mims et al. | 427/207.1 |
| 5,169,070 | 12/1992 | Mattson | 239/290 |

FOREIGN PATENT DOCUMENTS

| | | | |
|---|---|---|---|
| 843398 | 7/1939 | France | 239/415 |

*Primary Examiner*—Andres Kashnikow
*Assistant Examiner*—Lesley D. Morris
*Attorney, Agent, or Firm*—Harness, Dickey & Pierce, P.L.C.

[57] ABSTRACT

A hot air gun for drying a sprayed air-dryable liquid material is disclosed. The gun includes a hot air gun connected to both a source of hot pressurized air and a source of flowable air-dryable liquid material. The gun includes a body having a handle assembly and a spraying assembly. The handle assembly includes a depressible trigger and first knob for adjusting the amount of flowable liquid material in the spray and a second knob for adjusting the pattern of the spray. The spraying assembly includes a spray nozzle and control valves operably connected with the trigger for controlling the flow of pressurized hot air and liquid material. An air diverter is fitted between a port for allowing passage of air into the gun and the spray nozzle for diverting hot compressed air onto liquid material sprayed on a substrate.

20 Claims, 5 Drawing Sheets

16

12
42
26
24
46
44
48
20
28
30
36
18
50
52
32
22
34
38
54
S
10
56
62
60
58
P
66
64

AIR GUN FOR SPRAYING AND DRYING AIR-DRYABLE LIQUID MATERIALS

BACKGROUND OF THE INVENTION

1. Technical Field

The present invention is generally directed to the application of liquid materials. More particularly, the present invention is directed to an air gun for spraying and drying sprayed air-dryable liquid materials such as paints and adhesives.

2. Discussion

Adhesive materials are well-known and have been used since ancient times for providing or promoting adhesion between two articles. Earliest adhesives were based on naturally-occurring substances with little or no processing from their natural forms. Examples of some of these early adhesives include bitumen, fish oil, and certain tree resins. Many adhesives used today are still based on naturally-occurring substances, but have been subjected to processing.

The most notable development in adhesives in recent times has been the use of organic compound-based adhesives. These modern adhesives are based on the synthetic derivation of organic polymers. Solvent-based adhesives have been commonly used in the construction and manufacturing industries.

Typical of these types of adhesives is the "hot-melt" thermoplastic adhesive. Present-day versions of the hot-melt adhesive are composed of polymers such as ethylene-vinyl acetate copolymers, polyamides, polyesters, and polyethylene.

Hot-melt adhesives may be applied in a thick consistency or may be applied as a spray. Devices for spraying heated hot-melt adhesive materials are known. A typical example of such a device is disclosed in U.S. Pat. No. Re. 33,481, issued Dec. 11, 1990, to Ziecker et al. for ADHESIVE SPRAY GUN AND NOZZLE ATTACHMENT. The apparatus of the Ziecker et al. reference is directed to a spray system for spraying heated hot-melt adhesive in elongated strands or fibers in controlled spiral patterns.

In U. S. Pat. No. 5,065,943, issued Nov. 19, 1991, to Boger et al. for NOZZLE CAP FOR AN ADHESIVE DISPENSER a cap adapted for use with an adhesive dispensing device is disclosed. Like the device of Ziecker et al., the Boger et al. device lays down an elongated adhesive fiber onto a substrate in a controlled spiral pattern.

While these devices have utility in providing a method for dispensing solvent-based adhesives, these adhesives themselves are now generally regarded as being undesirable for widespread use. A popular solvent used in these adhesives has historically been trichlorofluoromethane (fluorotrichloromethane) derived from carbon tetrachloride and hydrogen fluoride. While providing very good adhesion, trichlorofluoromethane is now believed to be responsible in part for depletion of the ozone layer. As a result, methylene chloride (dichloromethane) has been more recently substituted for trichlorofluoromethane to overcome the ozone-depletion problem inherent in its use. However, methylene chloride is itself now believed to pose a danger as a carcinogen. It is now apparent that while solvent-based adhesives provide very good adhesion characteristics, their usefulness is severely compromised by their known and suspected dangers to people and the environment.

As a substitute for these adhesives, water-based adhesives have been more recently used. While overcoming the chemical dangers of solvent-based adhesives, the principal difficulty of these adhesives is that they dry very slowly when compared to their solvent-based counterparts, particularly when these adhesives are sprayed onto a substrate. Known systems for applying water-based adhesives that demonstrate an acceptable drying time are wanting.

SUMMARY OF THE INVENTION

It is therefore an object of the present invention to overcome the disadvantages of known adhesive spray systems by providing a device that allows the operator to apply a stream of drying air to the adhesive surface after it is sprayed to accelerate drying time.

It is a further object of the present invention to provide such an air gun which atomizes the liquid adhesive prior to its deposition on a substrate.

A further object of the present invention is to provide such a system that utilizes hot compressed air as a vehicle for atomizing and carrying the liquid adhesive to the target substrate.

Yet another object of the present invention is to provide a system for spraying adhesives that allows for adjustment of the spray pattern.

Still another object of the present invention is to provide such a system that is easy to operate and simple to maintain.

Yet a further object of the present invention is to provide a system for spraying and drying air-dryable liquid materials in additional to liquid adhesives, such materials including paint.

The present invention achieves these objectives by providing a system and process for spraying a liquid adhesive that comprises a hot air gun connected to a source of hot pressurized air and a source of flowable adhesive.

The gun includes a body having a handle assembly and a spraying assembly. The handle assembly includes a depressible trigger, a knob for adjusting the amount of the air-dryable liquid material relative to hot pressurized air in the air-liquid spray, and a knob for adjusting the pattern of the spray.

An air diverter is attached to the body of the gun for diverting an amount of hot compressed air from the air-liquid spray directly onto the sprayed substrate to accelerate drying of the liquid material. The air diverter includes a diverter body, a diverter plenum connected to the underside of the body, an air diverter piston axially movable within the air divert body top, and a piston shroud through which diverted air exits.

The spraying assembly of the gun includes a central spray nozzle provided within a head module and shut-off valves operably connected with the trigger for selectively controlling the flow of incoming pressurized hot air and liquid material. The spraying assembly also includes an air routing insert for routing air currents around and in front of the nozzle and a liquid material fluid tube for routing another current of compressed air and liquid material through the nozzle. The liquid material and the hot compressed air are discharged beyond the nozzle wherein the compressed air atomizes the liquid material. Additional opposed air channels are provided on the nozzle tip to allow passage of the air current directed around the front of the nozzle to fan the air-liquid material mixture so as to lay down a desired pattern of air-liquid spray.

The hot pressurized air source includes a compressor for compressing ambient air, a heat exchanger for heating the compressed air, and regulators for regulating the pressure of the hot compressed air entering the heat exchanger.

The flowable adhesive source includes a tank for holding air-dryable liquid material, a compressor for pressurizing the liquid material in the tank, and a regulator for regulating the amount of the liquid material entering the gun from the tank.

Other objects and advantages of the present invention will be made apparent as the description progresses.

BRIEF DESCRIPTION OF THE DRAWINGS

The present invention will be more fully understood by reference to the following detailed description of the preferred embodiments of the present invention when read in conjunction with the accompanying drawings, in which like reference characters refer to like parts throughout the views, and in which.

DETAILED DESCRIPTION OF THE PREFERRED EMBODIMENT

Figure 1:
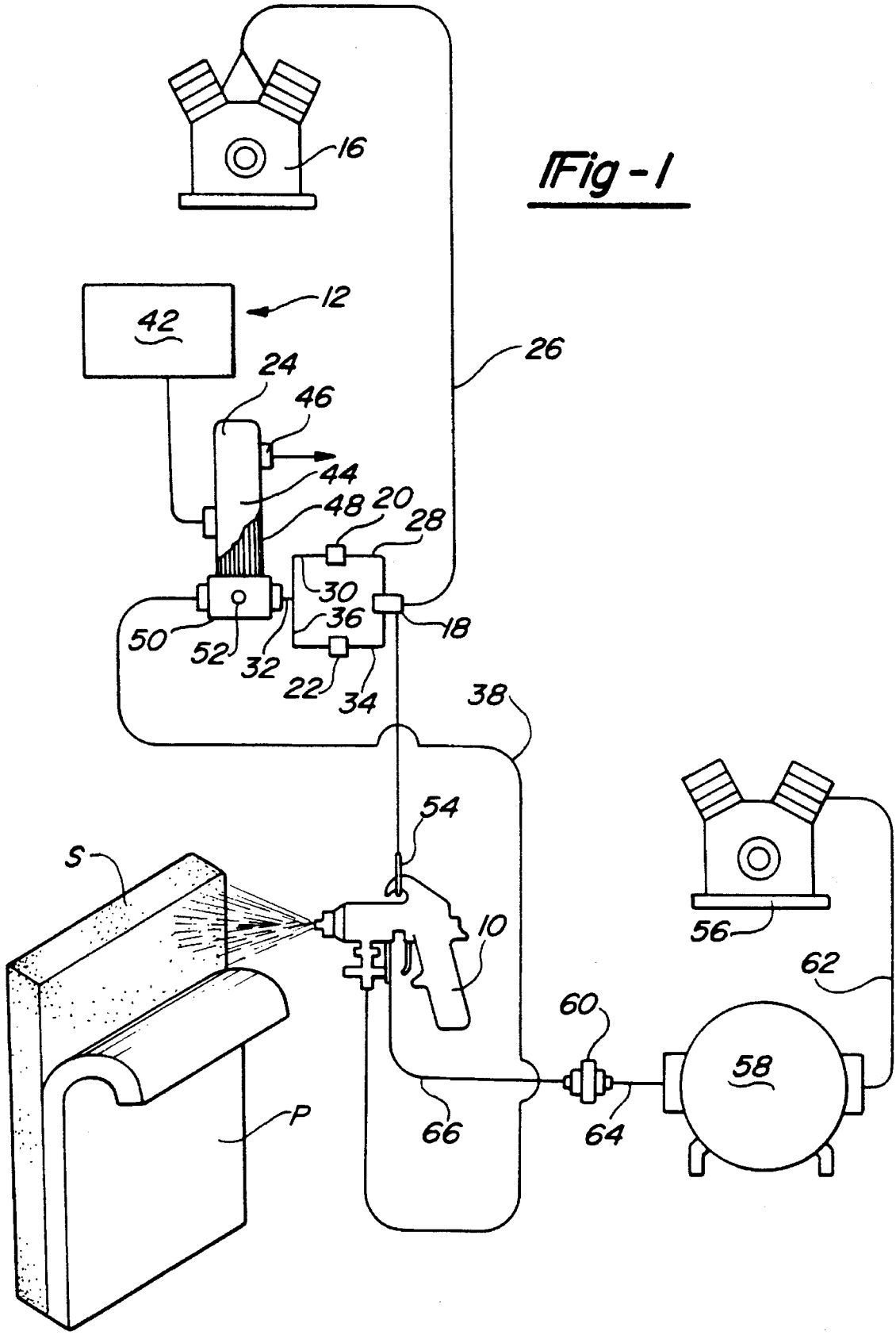
FIG. 1 is an environmental view illustrating a spraying system incorporating the hot air gun of the present invention for application of an air-dryable liquid material such as an adhesive to an article to be fastened to another article.

The drawing discloses the preferred embodiment of the present invention. While the configurations according to the illustrated embodiment are preferred, it is envisioned that alternate configurations of the present invention may be adopted without deviating from the invention as portrayed. The preferred embodiment is discussed hereafter.

With reference to FIG. 1, an environmental view of a spray application system incorporating a spray gun having an air diverter according to the present invention is illustrated with the spray gun being generally indicated as 10. The gun 10 combines air-dryable liquid material with hot compressed air to produce a hot spray consisting of a hot air-liquid material mixture containing atomized air-dryable liquid material. An air heating and pressurizing assembly 12 and a liquid material delivery system 14 provide the air and liquid material to the gun 10, which then combines it as an air-liquid spray. While being effective for spraying liquid adhesives, the gun 10 of the present invention also finds application in the spraying and drying of paints and other air-dryable liquid materials.

With the spraying of liquid adhesives primarily in mind, an air-adhesive spray is shown being applied to a substrate, generally illustrated as S, so that a piece, generally illustrated as P, may be attached thereto. The illustrated substrate S and the piece P of FIG. 1 are only illustrative, and the gun of the present invention may be used for adhering together any articles that may be bonded by an adhesive.

The air heating and pressurizing assembly 12 includes an air compressor 16 for compressing ambient air, a regulator selection switch 18 for switching air paths between a high-pressure regulator 20 and a low-pressure regulator 22, and a heat exchanger 24 for heating the compressed air. An air line 26 fluidly connects the compressor 16 with the regulator selection switch 18, a first compressed air input line 28 connects the switch 18 with the high-pressure regulator 20, and a high-pressure air line 30 connects the regulator 20 with a common air line 32. The common air line 32 is connected to the heat exchanger 24. A second compressed air input line 34 connects the switch 18 with the low-pressure regulator 22, and a low-pressure air line 36 connects the regulator 22 with the common air line 32. An insulated air line 38 connects the heat exchanger 24 with the gun 10.

The heat exchanger 24 is of known design and includes a heat source 42 powered by electricity or a flammable fuel that provides hot air to a distributor 44. An exhaust port 46 allows the hot, circulating air to exit the exchanger 24. The distributor 44 encases a series of sealed tubes 48 fluidly connected with a pressurized air channel 50 through which flows pressurized air regulated by the regulator 20 or the regulator 22, as will be described below. The pressurized air enters the channel 50, is circulated through the sealed tubes 48 which are surrounded by hot air, returns to the channel 50, and leaves the exchanger 24 to the gun 20. The heat exchanger 24 includes a temperature control knob 52 for selectively controlling the temperature of the exhausted compressed air.

The regulator selection switch 18 is fitted with a gun hanger 54. While the gun 10 is in use, compressed air is directed by the switch 18 (and associated air lines) to the high-pressure regulator 20 which regulates the incoming compressed air to an operating pressure of between 10–16 p.s.i. When the gun 10 is not in use, it is hung from the hanger 54, and the switch 18 diverts air from the line 28, through the line 34, and into the low-pressure regulator 22 which regulates the incoming compressed air to an idling pressure of between 1–2 p.s.i. (The heat exchanger 24 will not operate unless it receives at least 0.5 p.s.i. of compressed air at the channel 50.) A certain amount of air constantly exits the gun, as will be described in detail below.

The liquid material delivery system 14 includes a compressor 56 for compressing ambient air, a liquid material tank 58, and a fluid regulator 60. An air line 62 connects the compressor 56 to the tank 58, a first liquid material line 64 connects the tank 58 to the regulator 60, and a second liquid material line 66 connects the regulator 60 with the gun 10. The liquid material contained in the tank 58 and forced into the gun 10 is liquid at room temperature, but dries when exposed to ambient air.

Figure 2:
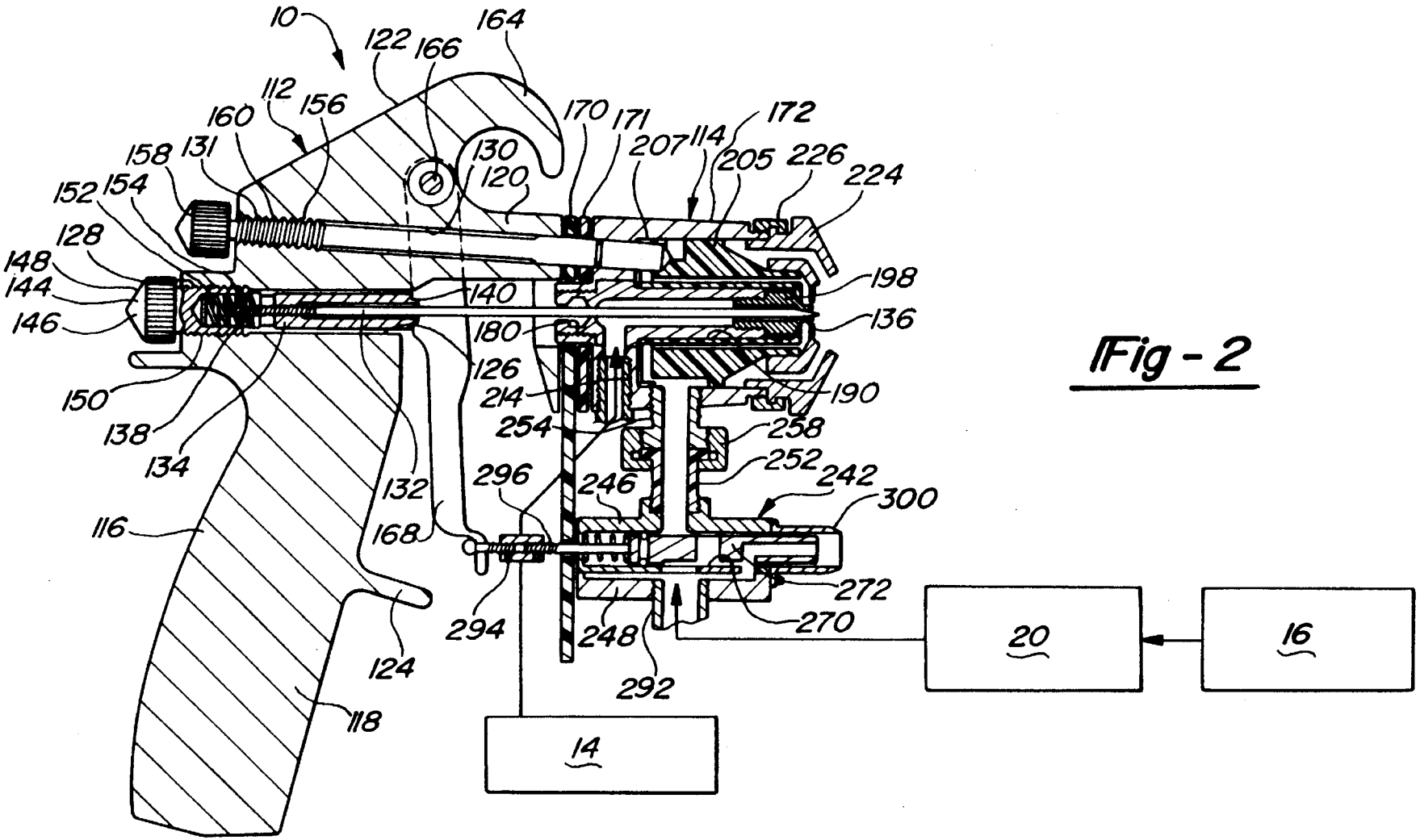
FIG. 2 is an elevational sectional view of the hot air gun of the present invention.
Figure 3:
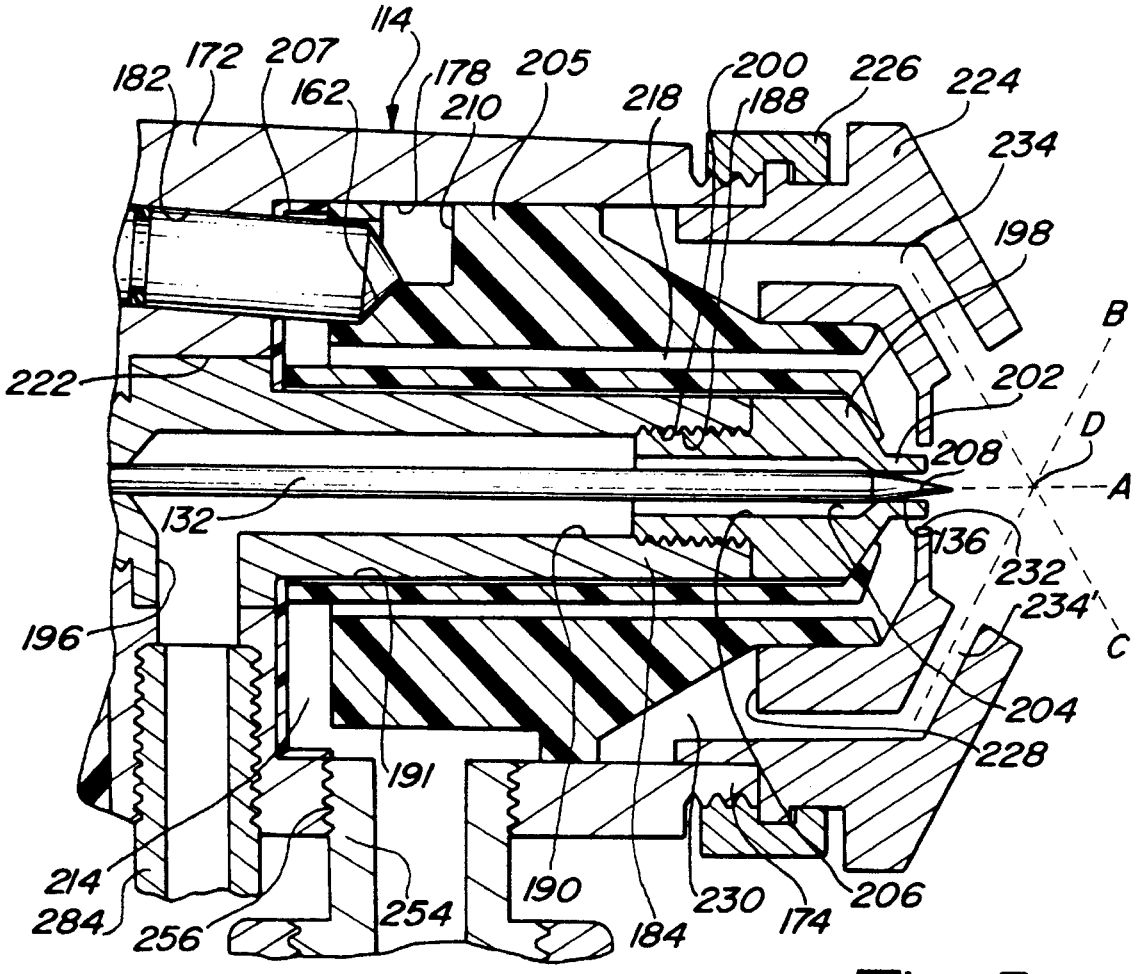
FIG. 3 is an enlarged portion of the sectional view of FIG. 2 illustrating the air insert of the present invention in its environment.
Figure 4:
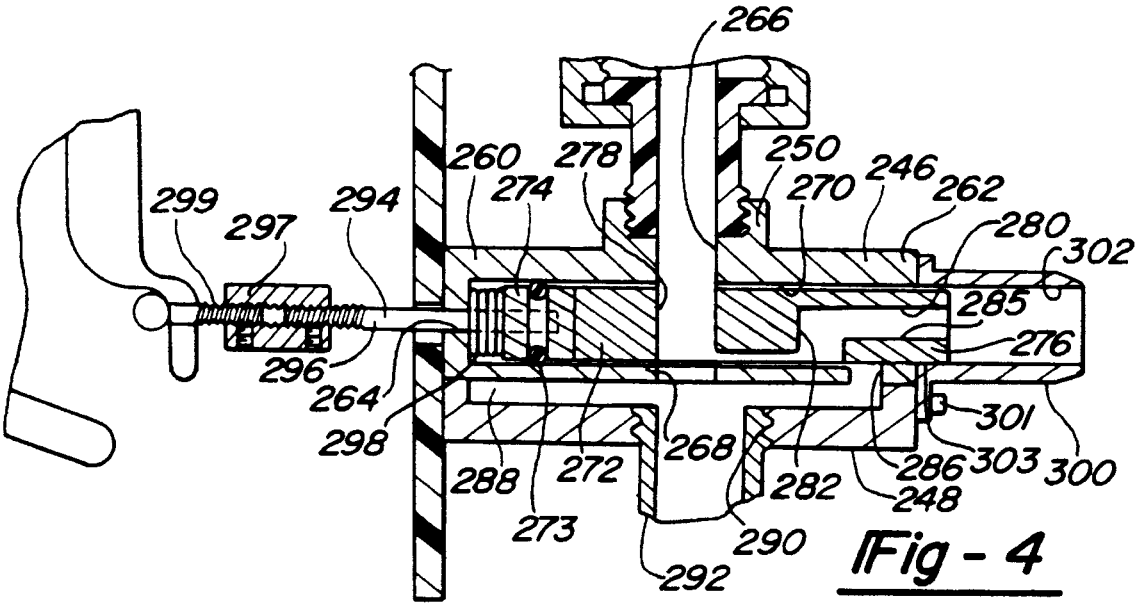
FIG. 4 is an enlarged portion of the sectional view of FIG. 2 illustrating the air diverter of the present invention in its environment.
Figure 8:
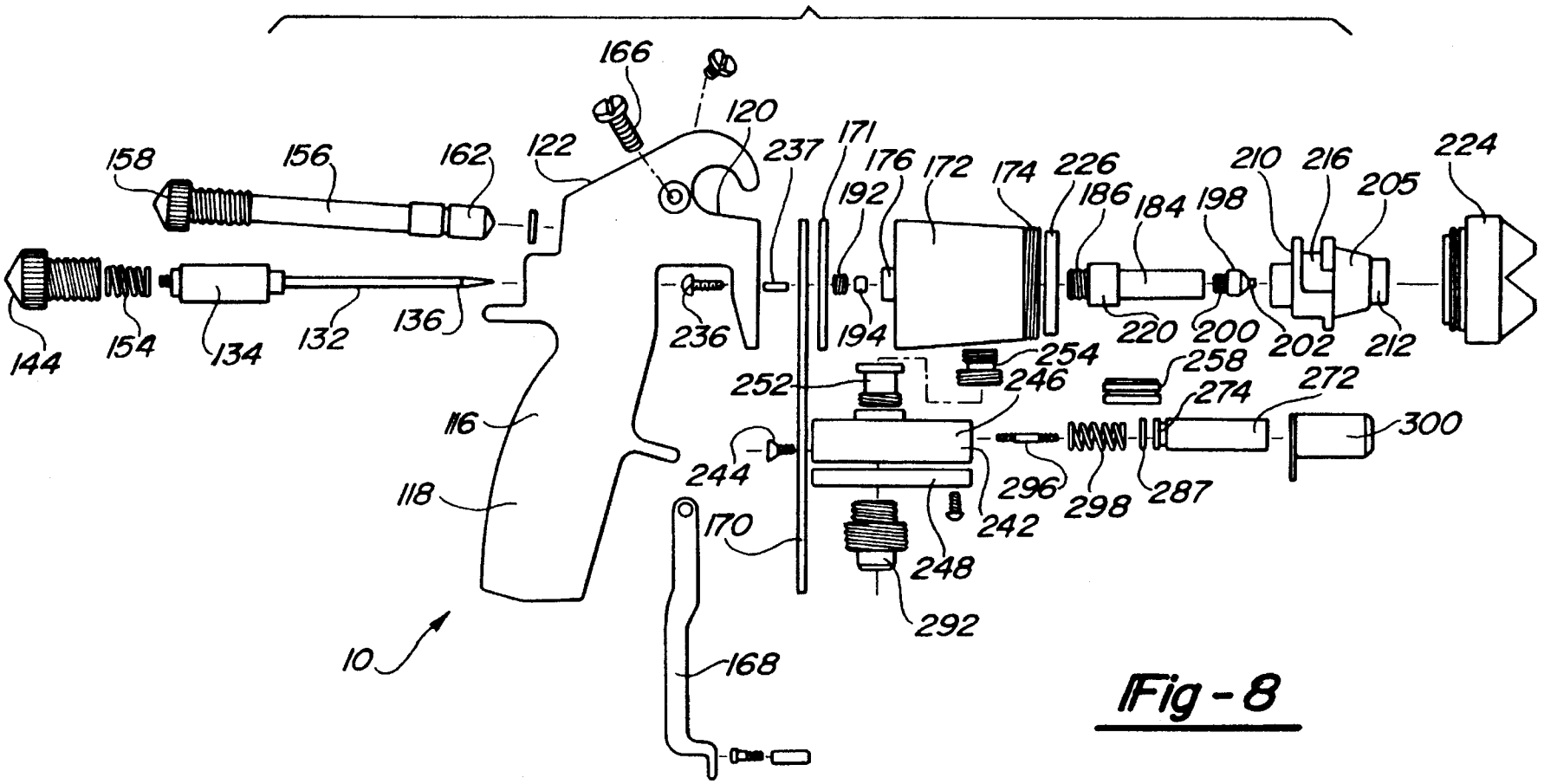
FIG. 8 is an exploded view of the hot gun of present invention.

FIGS. 2, 3, and 4 illustrate various sectional views of the air gun of the present invention. FIG. 8 is an exploded view of the gun 10. With particular reference to the figures, the gun 10 includes a handle assembly generally indicated as 112 and a spray assembly generally indicated as 114.

The handle assembly 112 includes a grip-type gun body 116. The body 116 is composed of a durable, lightweight material such as a plastic or a lightweight metal. The body 116 includes a grip portion 118, a spray assembly supporting portion 120, and an intermediate adjustment supporting portion 122. As illustrated, the grip portion 118 is configured to fit comfortably in the user's palm. To enhance the fit and to enable the user to better grip the gun 10, a finger support 124 is integrally mated with the grip portion 118.

The intermediate adjustment supporting portion 122 includes a first throughbore 126 having a threaded portion 128 and a second throughbore 130 having a threaded portion 131. The second throughbore 130 terminates at the spray assembly grip portion 118.

Within the first throughbore 126 is provided an axially-adjustable fluid adjusting needle 132 having a needle adjusting sleeve 134 and a pointed end 136, the function of which will be described in detail below. The adjusting sleeve 134 includes a spring biasing end 138 and a trigger abutment end 140.

A fluid volume control assembly 144 includes a knob 146 having a knurled end 148 and an opposite threaded end 150. The threaded end 150 is threadably adapted for mating with the threaded portion 128 of the throughbore 126. A counterbore 152 is defined within the threaded end 150 and extends into the knob 146. Nested substantially within the counterbore 152 is a fluid volume control return spring 154 that is biased between the endwall of the counterbore 152 and the spring biasing end 138 of the adjusting sleeve 134. The return spring 154 maintains the adjusting sleeve 134 in spaced-apart relation from the control assembly 144.

Within the second throughbore 130 is provided an axially-adjusted fan air control rod 156 having a knurled end 158, a threaded portion 160 adjacent the knurled end 158, and a conically-shaped shut-off end 162. The threaded portion 160 is threadably adapted for mating with the threaded portion 131 of the throughbore 130. The shut-off end 162 extends beyond the end of the spray assembly supporting portion 120 and into the spray assembly 114 as will be described in greater detail below.

A hanger 164 extends from the adjustment supporting portion 122 and enables the gun 10 to be hung, when not in use, on the hanger 54 as described above. While the hanger 164 is represented as having a particular "C"-shaped configuration, it must be understood that alternate configuration could as well be used.

Pivotally attached to the adjustment supporting portion 122 by a trigger axle 166 is a trigger 168. The trigger 168 is manipulated by the hand of an operator (not shown) to control the air-liquid material mixture escaping from the gun 10. The back side of the trigger 168 abuts the trigger abutment end 140 of the adjusting sleeve 134. When the operator squeezes the trigger 168 toward the grip portion 118, the spring 154 is compressed between the spring biasing end 138 of the sleeve 134 and the interior wall of the counterbore 152 of the knob 146. The spring 154 resists this movement and urges the trigger 168 forward to its resting position, as illustrated.

Between the handle assembly 112 and the spray assembly 114 is a spray assembly insulating plate 170 mated to an insulating disk 171. The temperature of the air entering the gun 10 is elevated to an operating temperature of between 325° F. and 400° F., while the temperature of the glue entering the gun 10 is elevated to an operating temperature of about 110° F. (but preferably below 120° F.). The insulation provided by the plate 170 and the disk 171 limits the transfer of heat from the spray assembly 114 to the handle assembly 112, thus enabling the operator to use the gun 10 with a reasonable degree of comfort. The plate 170 and the disk 171 are preferably composed of a rigid insulating polymerized material such as "Ultem" (trademark, GE Company) which is a polyethermide resin.

The spray assembly 114 comprises several screw-together or bolt-together components that are preferably composed of one of several rigid plastics or of a lightweight metal such as aluminum. The assembly 114 includes air and liquid material routing channels. The liquid material routing channels (described below) are preferably composed of material such as stainless steel. While naturally elevating manufacturing costs, stainless steel provides an advantage over brass in that many liquid materials (such as liquid adhesives) react with the brass such that the exposed portion of the brass tarnishes. There is no such reaction when liquid materials flow through stainless steel.

The assembly 114 includes a spray head module 172 having a slightly tapered body as illustrated. The module 172 includes an externally threaded end 174 and a sleeve end 176. Internally the module 172 defines a central counterbore 178 that opens toward the threaded end 174 and is continuous with the sleeve end 176 via a threaded throughbore 180. An additional smooth throughbore 182 is continuous between the exterior of the module 172 and the internal counterbore 178 to accommodate the shut-off end 162 of the rod 156.

Within the counterbore 178 is fitted a fluid tube 184 having an externally threaded end 186 and an internally threaded end 188. An axially-defined central throughbore 190 is defined within the fluid tube 184 and is continuous between the ends 186 and 188.

The threaded end 186 of the tube 184 is threadably mated with the threaded throughbore 180. A packing nut 192 is also threadably mated with the threaded throughbore 180. Between the inner side of the packing nut 192 and the end of the tube 184 is provided a packing 194 composed of a liquid-resistant material. The packing 194 is forced between the nut 192 and the tube 184 to create a fluid-tight seal, thus preventing fluid from escaping from the module 172 along the needle 132. The throughbore 190 intersects a radially-aligned fluid inlet bore 196. A fitting 284 is fitted in the bore 196 for fluid communication with the liquid material delivery system 14.

At the end of the tube 184 is a fluid nozzle 198 having an external thread 200 and a fluid tip 202. The thread 200 is threadably mated with the threaded end 188 of the tube 184. An axially-defined central throughbore 204 is defined within the nozzle 198. The throughbore 204 includes a wide region 206 that communicates with the throughbore 190 and a restricted region 208 that provides a seat for the pointed end 136 of the needle 132 within the tip 202.

It may be accordingly understood that clockwise rotation of the knob 146 further biases the spring 154 against the adjusting sleeve 134 urging the assembly so that the pointed end 136 extends further toward the needle seat defined within the nozzle 198. Counterclockwise rotation of the knob 146 causes the pointed end 136 to move away from the seat.

Figure 5:
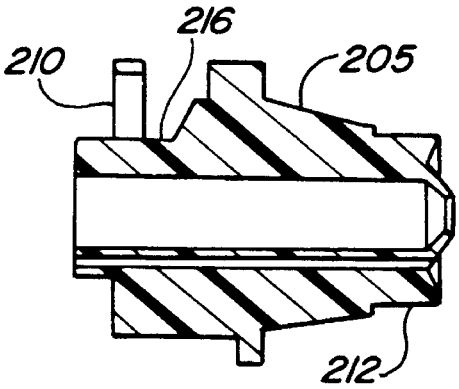
FIG. 5 is a sectional view of one side of the air insert of the present invention.
Figure 6:
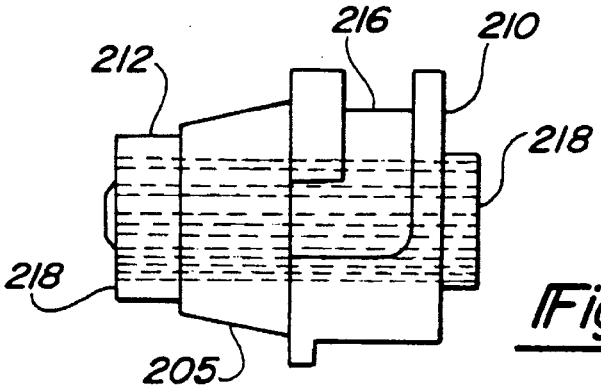
FIG. 6 is a view illustrating the side of the insert opposed to the side shown in FIG. 5.
Figure 7:
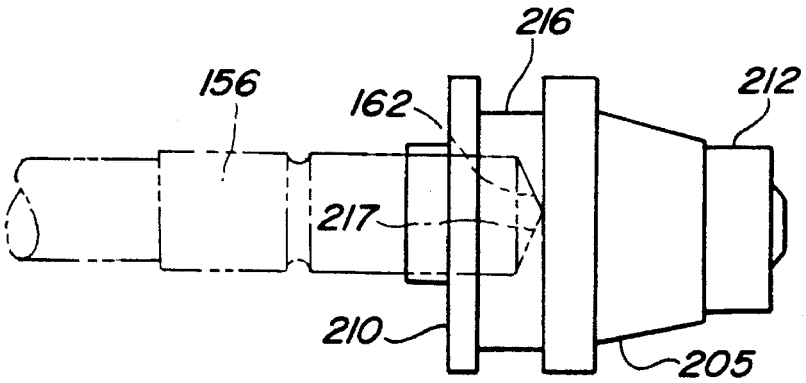
FIG. 7 is a top view of the insert shown in FIGS. 5 and 6.

Also fitted within the counterbore 178 of the head module 172 is an air routing insert 205. The insert 205 is best seen in FIGS. 5 through 7 which shows it in various views. The insert 205 includes a cavity-defining end 210 and a nozzle end 212. As illustrated in FIG. 2, the cavity-defining end 210 of the insert 205 is disposed within the module 172 in a spaced-apart relationship from an insulating cup 207 of the counterbore 178, thus defining a cavity 214. The cavity 214 is an air passage that fluidly communicates with the air heating and pressurizing assembly 12 described above.

An air-routing channel 216 is defined on the outside of the insert 205. The channel 216 wraps partially around insert 205, travelling from right to left (as viewed by the reader) on the insert 205 as illustrated in FIG. 6 and travels from left to right on its opposite side. The channel 216 begins at the top dead center of the insert 205 (best seen in FIG. 7) then curves down to follow the long axis of the insert on both sides, defining a continuous channel. A seat 217, shown in FIG. 7, is defined at that point of the channel 216 that is top dead center of the insert 205 for seating the shut-off end 162 of the rod 156. The end 162 is shown in shadow lines in FIG. 7 in its fully seated position, thus closing off air flow between the cavity 214 and the channel 216. The channel 216 directs a controlled amount of air in two separate streams toward the tip of the fluid nozzle 198.

Rotation of the knurled end 158 in a clockwise direction adjusts the rod 156 forward into the seat 217 of the air-routing channel 216 reducing the amount of hot pressurized air entering the channel. Counterclockwise rotation of the knurled end 158 achieves the opposite result.

A series of air passageways 218 (shown in FIGS. 2 and 3 and in shadow lines in FIG. 6) are defined in an array around a central throughbore 191 of the insert 205. The passageways 218 allow passage of hot pressurized air between the cavity 214 and the nozzle end 212. The air routing insert 205 and the insulating cup 207 are each composed of an insulating rigid polymerized material which is preferably the same polyetherimide resin used in the spray assembly insulating plate 170 and the insulating disk 171 described above. Accordingly, the hot air entering the gun 10 is thereby further insulated from losing heat to the heat-transmissive metal of the assembly 114. In addition, and perhaps more importantly, while the air passing through the air routing channel 216 contacts the module 172, the air passing between the cavity 214 to the nozzle end 212 through the air passageways 218 never contacts any metal components, thus minimizing the loss of heat through transmission to the metal and subsequent dissipation into surrounding ambient air.

The tube 184 includes an annular flange 220 adjacent the threaded end 186 that fits snugly into a bore 222 defined between and concentric with the throughbore 180. Seated in this manner, part of the tube 184 is suspended within the central throughbore 191 defined axially within the insert 205. This is seen in FIGS. 2 and 3.

Attached to the threaded end 174 is an air cap 224 fastened to the module 172 by an internally threaded ring 226. The air cap 224 includes an inner wall 228 that is positioned in spaced-apart relation from the nozzle-supporting end of the tube 184, thus defining a cavity 230. A circular aperture 232 is defined in the inner wall 228 through which the tip 202 of the nozzle 198 is disposed. The aperture 232 is larger than the circumference of the tip 202, and an air passage in the shape of a ring is defined between the two. In operation, hot pressurized air from the cavity 214 passes through the passageways 218 and along the tip 202 through the aperture 232, where it forms a spray stream with the liquid material, the stream being generally indicated as A in FIG. 3, exiting from the middle of the tip 202. The liquid material is atomized by this current of air.

The cap 224 includes a pair of opposed air channels 234 and 234'. These channels 234 and 234' are in fluid communication with the cavity 214, thus providing two opposed fanning air currents B and C that exhaust the air cap 224 concurrent with the air-liquid material mix A. The two air currents B and C exiting the cap 224 are directed angularly toward one another such that they intersect each other and the stream A in front of the tip 202 approximately at point D. The intersecting air currents B and C fan the current A to form a controlled (via operator adjustment of the control rod 156) lay-down pattern of the liquid material.

The assembly 114 is connected to the grip portion 118 by a pair of fasteners of which one, 236, may be seen. The fastener 236 and its unseen twin are provided to both sides of a dowel pin 237. The fasteners 236 are preferably screws that are provided through the plate 170, the insulating disk 171, and into the module 172.

The plate 170 provides support for an air diverter 242. The diverter 242 and the plate 170 are fastened together by a pair of screws of which only one, 244, may be seen. The air diverter 242 is shown in FIGS. 2 and 4.

The air diverter 242 includes an air diverter body 246 and an air diverter plenum 248. On the upper side of the diverter body 246 is provided a pressurized fluid exhaust port 250. The exhaust port 250 is fluidly connected with the cavity 214 defined between the cup 207 of the module 172 and the insert 205 by an air insulating outlet fitting 252 and an air inlet fitting 254. The top end of the air inlet fitting 254 is threaded into an aperture 256 defined in the underside of the module 172. The top end of the air insulating outlet fitting 252 is mated with the air inlet fitting 254 by a ring nut 258. The bottom end of the air insulating outlet fitting 252 is threaded into the exhaust port 250. Compressed air exiting the air diverter 242 is thus in fluid communication with the cavity 214 through the fittings 252 and 254.

The air diverter body 246 includes a first end 260 and a second end 262. The first end 260 includes an aperture 264. As best illustrated in FIG. 4, the second end 262 is substantially open. An air exhausting aperture 266 is defined on the top side of the air diverter body 246 within the inner wall of the exhaust port 250. Substantially aligned with the exhaust aperture 266 is an intake aperture 268 defined in the bottom side of the air diverter body 246. An axial bore 270 is defined within the air diverter body 246.

An air diverter piston 272 is axially movable within the bore 270 of the air diverter body 246 and is movable between a first, air-blocking position (as illustrated in FIG. 2) and a second, air-passing position (as illustrated in FIG. 4). The piston 272 includes a pull rod attachment end 274 and an air diverting end 276. An O-ring surrounds a portion of the pull rod attachment end 274 of the piston 272 and provides a seal between the piston 272 and the bore 270. A bore 278 is defined transverse with respect to the long axis of the piston 272.

The piston 272 also includes an L-shaped air diverter channel 280. The channel 280 begins upstream at an intake aperture 282 and terminates downstream at an exhaust aperture 285. An air diverter aperture 286 is defined in the bottom side of the air diverter body 246.

The air diverter plenum 248 is fitted to the underside of the air diverter body 246. An air cavity 288 is defined between the underside of the air diverter body 246 and the air diverter plenum 248. A threaded compressed air inlet port 290 is defined on the underside of the air diverter plenum 248. An air inlet hose fitting 292 is threadably mated with the threaded air inlet port of the air diverter plenum 248.

A piston control assembly 294 controls axial movement of the piston 272. The assembly 294 includes a connecting pull rod 296 that connects the lowest end of the trigger 168 with the pull rod attachment end 274 of the piston 272. A threaded adjustment sleeve 297 is threadably mated with the leftward end (from the perspective of the reader) of the rod 296 and the rightward end of a trigger attachment rod 299. Rotation of the sleeve 297 one way or the other adjusts the distance between the bottom end of the trigger 168 and the push rod attachment end 274 of the piston 272. The rod 296 is axially movable through the aperture 264 defined in the end 260 of the air diverter body 246. A piston return spring 298 is provided between the inner side of the end 260 and the piston 272. The spring 298 urges the piston 272 toward its closed position as illustrated in FIG. 2. A shroud 300 is attached to the air diverter body 246 by a fastener 301 and has a drying air aperture 302 defined in one end.

Hot pressurized air enters the lower end of the air inlet hose fitting 292 and is directed to the cavity 288. The position of the piston 272 determines whether or not hot compressed air is allowed to enter the gun 10.

When the position is moved to its open, air-passing position as shown in FIG. 4, compressed air is allowed to pass between the intake aperture 268 and the exhaust aperture 266 through the bore 278 for passage into the gun 10. Conversely, if the piston 272 is in its closed position (as shown in FIG. 2) where the bore 278 is out of alignment with the apertures 266 and 268, air passage into the module 172 is blocked while a small amount of air is allowed to pass out of the channel 230 as will be described more fully below. At the same time, the aperture 282 of the passage 280 is aligned with the aperture 286 of the air diverter body 246, thus allowing hot compressed air to be diverted from the gun 10 through the channel 280 and through the drying air aperture 302 and out of the shroud 300.

Operation of the gun 10 of the present invention is as follows. When the trigger 168 is in its closed or resting position, as illustrated in FIG. 2, flow of the pressurized and heated air into the cavity 214 is blocked by the closed, non-aligned position of the piston 272. The pointed end 136 of the needle 132 is also seated in the tip 202 of the nozzle 198.

When the operator squeezes the trigger 168 toward the grip portion 118, two events simultaneously occur. First, the piston 272 is moved forward in response to forward movement of the connecting rod 296, and heated and pressurized air enters the cavity 214, passing both around the tip 202 and through the air channel 216, while also passing through the channel 216 and out of the air cap 224 through the air channels 234 and 234'. Second, the liquid material in the throughbore 190 is allowed to pass through the tip 202 in response to the point of the needle 132 being drawn away from its seat within the nozzle 198 on the action of the sleeve 134 being rearwardly acted upon by the trigger 168. When the trigger 168 is released, some air is diverted from the gun 10 by being routed through the air diverter channel 280 and beyond the shroud 300 in the same general direction as the air-liquid spray.

Adjustment of both flow of the liquid material out of the tip 202 and flow of the air comprising the air fan may be readily made. Flow of the liquid material is adjusted by rotation of the knob 146 clockwise or counterclockwise as set forth above. The amount of fan air passing through the channel 216 is controlled by rotation of the knurled end 158 of the rod 156 also as set forth above.

Preferably, the temperature control knob 52 of the heat exchanger 24 is adjusted to between 125 and 600 degrees F. However, air diverted through the diverter 242 will cause this overall temperature to be reduced by between 50 and 100 degrees F. For example, if the heat exchanger 20 is set to 500 degrees F., air in the air-liquid material mixture will have a temperature of approximately 350 degrees F.

As noted, when the gun 10 is hung upon the hanger 54, the pressure to the gun 10 is reduced. However, at all times (even when the gun 10 is not on the hanger 54), a small amount of air is allowed to pass through the diverter 242 so that a positive pressure is created at the open end of the shroud 300 thereby preventing the build-up of liquid material in the working parts of the diverter 242. A channel 303 is axially defined along the underside of the piston 272 for this purpose. The channel 303 allows air to pass between the intake aperture 268 and the L-shaped air diverter channel 280. As such, air is constantly allowed to pass between the air cavity 288 and out of the shroud 300 thereby providing a positive pressure at the tip of the shroud 300. This design serves the added functions of preventing the heat exchanger 24 from overheating while also allowing enough air to pass through the exchanger 24 so that a full warm up of the exchanger 24 is eliminated on the subsequent use of the gun 10.

Drying time of the sprayed material depends on the ambient air conditions (temperature and humidity), film thickness, and the temperature of the heated compressed air. Drying of the sprayed material is enhanced by air diverted from the gun 10 through the air diverter 242. The user uses this feature advantageously by fanning the sprayed liquid material applied to the substrate with air from the diverter 242.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A spray gun for attachment to a source of hot pressurized air and a source of liquid material for spraying air-dryable liquid materials as an air-liquid spray, said spray gun comprising:

a liquid material gun body having a liquid material channel for carrying liquid material and a hot pressurized air channel for carrying pressurized air, said gun further including a liquid material inlet port for attachment to a source of liquid material, said liquid material inlet port being continuous with said liquid material channel, said gun body further including a pressurized air inlet port for attachment to a source of pressurized air, said pressurized air inlet port being continuous with said pressurized air channel, said gun body further including a nozzle, said nozzle having an air-liquid material mixing area where said pressurized air combines with said liquid material to form an air-liquid spray, said liquid material channel being continuous with said air-liquid material mixing area of said nozzle, said hot pressurized air channel being continuous with said air-liquid material mixing area of said nozzle;

an air diverter including a body having a diverter valve-receiving bore, said body having a pressurized air channel outlet and a diverted air outlet, said pressurized air channel outlet being continuous with said pressurized air channel of said gun body, said body having a pressurized air inlet and a diverted air inlet, said diverter further including a diverter valve movable within said valve-receiving bore of said body, said diverter valve including an air channel bore and a diverted air bore, said diverter valve being movable between an air-passing position wherein said air channel bore is in alignment with said pressurized air channel outlet and said pressurized air channel inlet and said diverted air bore is in alignment with said diverted air outlet and said diverted air inlet and an air-blocking position wherein said air channel bore is out of alignment with said pressurized air channel outlet and said pressurized air channel inlet and said diverted air bore is out of alignment with said diverted air outlet and said diverted air inlet; and means for moving said diverter valve between said air-passing position and said air-blocking position.

2. The spray gun of claim 1 wherein said gun body further includes an air flow valve associated with said pressurized air channel and a liquid material flow valve associated with said liquid material channel, said gun body further including a trigger operatively associated with said air flow valve and said liquid material flow valve, said means for moving said diverter valve comprising a connecting rod connecting said trigger of said gun body and said diverter valve of said diverter.

3. The spray gun of claim 1 wherein said diverter valve-receiving bore of said diverter body has a long axis and said diverter valve comprises an elongated piston movably provided within said valve-receiving bore.

4. The spray gun of claim 3 wherein said air channel bore of said elongated piston is transversely defined relative said long axis.

5. The spray gun of claim 3 wherein said diverter body has a diverted air exit end, said diverted air outlet being defined in said diverted air exit end, said diverter further including a diverted air shroud fitted over said diverted air exit.

6. The spray gun of claim 1 wherein said diverter further includes a plenum, said plenum being attached to said body and defining a cavity therebetween, said plenum having a pressurized plenum air inlet, said pressurized plenum air inlet being continuous with said pressurized air channel inlet and said diverted air inlet of said diverter body through said cavity.

7. The spray gun of claim 1 wherein said liquid material is a paint.

8. The spray gun of claim 1 wherein said liquid material is an adhesive.

9. A spray gun for attachment to a source of hot pressurized air and a source of liquid material for spraying air-dryable liquid materials as an air-liquid spray, said spray gun comprising:

a liquid material gun body having a liquid material channel for carrying liquid material and a hot pressurized air channel for carrying hot pressurized air, said gun further including a liquid material inlet port for attachment to a source of liquid material, said liquid material inlet port being continuous with said liquid material channel, said body gun further including a hot pressurized air inlet port for attachment to a source of hot pressurized air, said hot pressurized air inlet port being continuous with said hot pressurized air channel, said gun body further including a nozzle, said nozzle having an air-liquid material mixing area where said hot pressurized air combines with said liquid material to form an air-liquid spray, said liquid material channel being continuous with said air-liquid material mixing area of said nozzle, said hot pressurized air channel being continuous with said air-liquid material mixing area of said nozzle, said gun body further including an air flow valve associated with said hot pressurized air channel and liquid material flow valve associated with said liquid material channel, said gun body further including a trigger operatively associated with said air flow valve and said liquid material flow valve;

an air diverter including a body having a long axis, said body having an axially-defined bore, said body having a hot pressurized air channel outlet and a diverted air outlet, said hot pressurized air channel outlet being continuous with said hot pressurized air channel of said gun body, said body having a hot pressurized air channel inlet and a diverted air inlet, said diverter further including a diverter piston movable within said axially-defined bore of said body, said diverter piston including an air channel bore and a diverted air bore, said piston being movable between an air-passing position wherein said air channel bore is in alignment with said hot pressurized air channel outlet and said hot pressurized air channel inlet and said diverted air bore is in alignment with said diverted air outlet and said diverted air inlet and an air-blocking position wherein said air channel bore is out of alignment with said hot pressurized air channel outlet and said hot pressurized air channel inlet and said diverted air bore is out of alignment with said diverted air outlet and said diverted air inlet, said diverter further including a plenum, said plenum being attached to said body and defining a cavity therebetween, said plenum having a hot pressurized plenum air inlet, said hot pressurized plenum air inlet being continuous with said hot pressurized air channel inlet and said diverted air inlet through said cavity; and a connecting rod connecting said trigger of said gun body and said diverter piston of said air diverter whereby said diverter piston is moved between said air-passing and said air blocking positions upon operation of said trigger.

10. The spray gun of claim 9 wherein said air channel bore of said elongated piston is transversely defined relative said long axis.

11. The spray gun of claim 9 wherein said diverter body has a diverted air exit end, said diverted air outlet being defined in said diverted air exit end, said diverter further including a diverted air shroud fitted over said diverted air exit end.

12. The spray gun of claim 9 wherein said liquid material is a paint.

13. The spray gun of claim 9 wherein said liquid material is an adhesive.

14. An air diverter for disposition between a source of pressurized air and a pressurized air channel of a spray gun in combination with a spray gun used for spraying an air-liquid spray, said air diverter comprising:

an air diverter body having a diverter valve-receiving bore, said body having a pressurized air channel outlet and a diverted air outlet, said pressurized air channel outlet being continuous with said pressurized air channel of said spray gun, said body having a pressurized air inlet and a diverted air inlet, said diverter further including a diverter valve movable within said valve-receiving bore of said body, said diverter valve including an air channel bore and a diverted air bore, said diverter valve being movable between an air-passing position wherein said air channel bore is in alignment with said pressurized air channel outlet and said pressurized air channel inlet and said diverted air bore is in alignment with said diverted air outlet and said diverted air inlet and an air-blocking position wherein said air channel bore is out of alignment with said pressurized air channel outlet and said pressurized air channel inlet and said diverted air bore is out of alignment with said diverted air outlet and said diverted air inlet.

15. The combination of claim 14 wherein the air diverter further includes means for moving said diverter valve between said air-passing position and said air-blocking position, said gun further includes an air flow valve associated with said pressurized air channel, and a trigger operatively associated with said air flow valve, said means for moving said diverter valve comprising a connecting rod connecting said trigger of said body and said diverter valve of said diverter.

16. The combinations of claim 14 wherein said diverter valve-receiving bore of said diverter body has a long axis and said diverter valve comprises an elongated piston movably provided within said valve-receiving bore.

17. The combinations of claim 16 wherein said air channel bore of said elongated piston is transversely defined relative said long axis.

18. The combinations of claim 16 wherein said diverter body has a diverted air exit end, said diverted air outlet being defined in said diverted air exit end, said diverter further including a diverted air shroud fitted over said diverted air exit.

19. The combinations of claim 14 wherein said diverter further includes a plenum, said plenum being attached to said body and defining a cavity therebetween, said plenum having a pressurized plenum air inlet, said pressurized plenum air inlet being continuous with said pressurized air channel inlet and said diverted air inlet of said diverter body through said cavity.

20. The combinations of claim 14 wherein said diverted air bore defines substantially a ninety-degree angle between said diverted air inlet and said diverted air outlet.

* * * * *